US006256814B1

(12) United States Patent
Drobinski

(10) Patent No.: US 6,256,814 B1
(45) Date of Patent: Jul. 10, 2001

(54) PLAYYARD

(75) Inventor: Jerome J. Drobinski, Reading, PA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/508,946

(22) PCT Filed: Sep. 18, 1998

(86) PCT No.: PCT/US98/19456

§ 371 Date: May 24, 2000

§ 102(e) Date: May 24, 2000

(87) PCT Pub. No.: WO99/15052

PCT Pub. Date: Apr. 1, 1999

Related U.S. Application Data

(60) Provisional application No. 60/059,376, filed on Sep. 19, 1997.

(51) Int. Cl.[7] ..... A47D 7/00

(52) U.S. Cl. ..... 5/99.1; 5/98.1; 248/169

(58) Field of Search ..... 5/93.1, 98.1, 99.1; 248/169

(56) References Cited

U.S. PATENT DOCUMENTS 4,688,280 * 8/1987 Kohus et al. ..... 5/99.1
4,739,527 * 4/1988 Kohus et al. ..... 5/99.1
4,811,437 * 3/1989 Dillner et al. ..... 5/99.1
5,239,714 * 8/1993 Huang ..... 5/99.1
5,279,006 * 1/1994 Teng ..... 5/99.1
5,339,470 * 8/1994 Shamie ..... 5/98.1
5,353,451 * 10/1994 Hsiung ..... 5/99.1
5,358,220 * 10/1994 Yu-Kuang ..... 5/99.1 X
5,465,439 * 11/1995 Chien ..... 5/99.1
5,504,951 * 4/1996 Yeh ..... 5/99.1
5,697,111 * 12/1997 Dillner et al. ..... 5/99.1
5,699,997 * 12/1997 Huang ..... 5/99.1 X
5,819,342 * 10/1998 Williams ..... 5/99.1
5,937,457 * 8/1999 Wang ..... 5/99.1

* cited by examiner

*Primary Examiner*—Terry Lee Melius
*Assistant Examiner*—Robert G. Santos
(74) *Attorney, Agent, or Firm*—Barnes & Thornburg

(57) ABSTRACT

A playyard floor support frame includes a rail mount (32) and at least two floor support rails (36, 40). Each floor support rail (36, 40) includes a stationary end piece (134) mounted on an inner end pivotably coupled to the rail mount (32) to enable each floor support rail (36, 40) to be moved relative to the rail mount (32) about a pivot axis (120) between an erected configuration adapted to support a floor mat on the floor support rails (36, 40) and above the rail mount (32) and a collapsed configuration adapted to facilitate storage of the floor support frame, and a rail lock apparatus (62) coupled to the rail mount (32) and configured to latch onto the stationary and piece (134) of selected floor support rails (36, 40) and to block pivoting movement of the selected floor support rails (36, 40) relative to the rail mount (32) about the pivot axes (120) to lock the selected floor support rails (36, 40) to the rail mount (32) upon movement of the floor support rails (36, 40) relative to the rail mount (32) to the erected configuration.

26 Claims, 13 Drawing Sheets

PLAYYARD

This Application is a 371 of PCT/US98/19456 Sep. 18, 1998 which claims benefit of Ser. No. 60/059,376 Sep. 19, 1997.

BACKGROUND AND SUMMARY OF THE INVENTION

The present invention relates to a juvenile playyard, and particularly to a collapsible frame for a juvenile playyard. More particularly, the present invention relates to a collapsible playyard frame including support rails and feet for elevating and supporting a floor mat in a juvenile playyard.

According to the present invention, a playyard floor support frame includes a rail mount and at least two floor support rails. Each floor support rail includes an inner end pivotably coupled to the rail mount to enable each floor support rail to be moved relative to the rail mount about a pivot axis between an erected configuration adapted to support a floor mat on the floor support rails and above the rail mount and a collapsed configuration adapted to facilitate storage of the floor support frame.

The playyard floor support frame further includes a rail lock apparatus coupled to the rail mount. The rail lock apparatus is configured to latch onto a stationary end piece mounted on the inner end of selected floor support rails to block pivoting movement of the selected floor support rails relative to the rail mount about the pivot axes to lock the selected floor support rails to the rail mount upon movement of the floor support rails relative to the rail mount to the erected configuration. The rail lock apparatus is arranged to underlie a floor mat supported in the playyard on the floor support rails.

In preferred embodiments, the rail mount includes a base and the rail lock apparatus includes two rail locks mounted for movement in the base between engaged positions engaging and locking the selected floor support rails against movement relative to the base to establish the erected configuration and released positions unlocking the selected support rails to allow pivotable movement of the selected floor support rails about the pivot axes to the collapsed configuration. The playyard floor support frame includes four floor support rails arranged to lie in an X-shaped pattern and each of the rail locks is movable relative to be base to engage one of the four floor support rails and lock it to the base of the rail mount.

The rail lock apparatus further includes spring means for yieldably biasing each rail lock to the engaged position. The spring means includes a coiled compression arranged to urge a first of the rail locks to engage and lock the inner end of one of the floor support rails and to urge a second of the rail locks to engage and lock the inner end of another of the floor support rails.

The rail lock apparatus further includes a lever pivotably coupled to the base for movement about a horizontal pivot axis (that is arranged to hie substantially parallel to the ground underlying the playyard when the playyard including the floor support frame is erected) between locked and unlocked positions. The lever is coupled to the two rail locks and configured to move the two rail locks toward one another to assume the released positions in response to pivoted movement of the lever relative to the base about the horizontal pivot axis of the lever.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
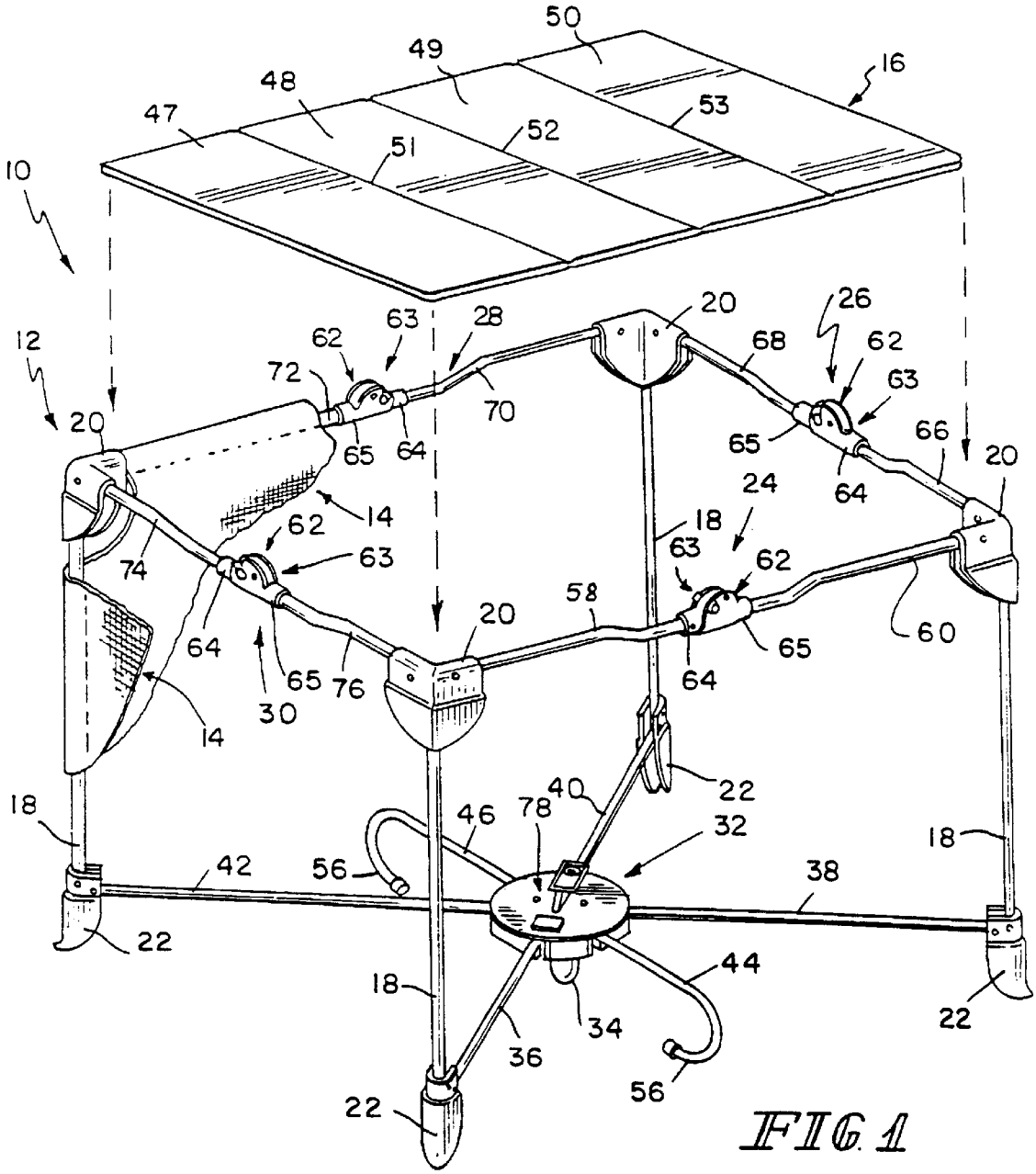
FIG. 1 is a perspective view of a collapsible playyard including a frame in accordance with the present invention, a fabric frame cover, and a floor mat for installation in the frame.

Playyard 10 includes a collapsible frame 12, fabric frame cover 14, and removable floor mat 16. Frame cover 14 is made of sturdy fabric and netting material and is foldable to enable frame 12 to be moved easily from an erected configuration shown in FIGS. 1–4 to a collapsed configuration shown in FIGS. 6–8. Floor mat 16 is removed from frame 12 (as shown in FIG. 1) prior to collapsing frame 12. Once frame 12 is collapsed, the four-segment floor mat 16 can be folded, "wrapped" around collapsed frame 12, and secured using straps (not shown) to provide a "case" for storing and/or carrying collapsed frame 12.

Collapsible frame 12 includes four corner legs 18, a corner piece 20 at the top end of each corner leg 18, and a corner foot 22 at the bottom end of each corner leg 18. Frame 12 also includes a foldable top rail 24, 26, 28, or 30 interconnecting each pair of adjacent corner pieces 20. Frame 12 further includes a rail mount 32, a foot 34 for elevating rail mount 32, and a support rail 36, 38, 40, or 42 interconnecting rail mount 32 and each of the corner feet 22. Frame 12 also includes two auxiliary support rails 44, 46 coupled to rail mount 32.

Floor mat 16 includes four sections 47, 48, 49, and 50 arranged in series as shown in FIG. 1. Section 47 is coupled to section 48 at fold line 51, section 48 is coupled to section 49 at fold line 52, and section 49 is coupled to section 50 at fold line 53. Floor mat 16 can be "unrolled" to assume the flat configuration shown in FIG. 1 and then dropped in place to provide a sturdy playyard floor supported in an elevated position above the ground 54 underlying playyard 10 by rail mount 32 and support rails 36, 38, 40, 42, 44, and 46.

Figure 6:
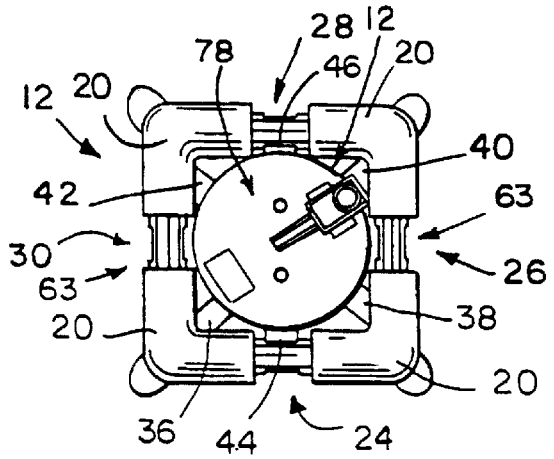
FIG. 6 is a top plan view of the playyard of FIG. 2 after the floor mat has been removed and the playyard frame has been fully collapsed showing the rail mount, six support rails pivotably coupled to the rail mount, and a pivotable lever arranged to move a pair of diagonally spaced releasable rail locks positioned in the rail mount below the cover plate to lie between two diagonally spaced-apart, lockable support rails.
Figure 8:
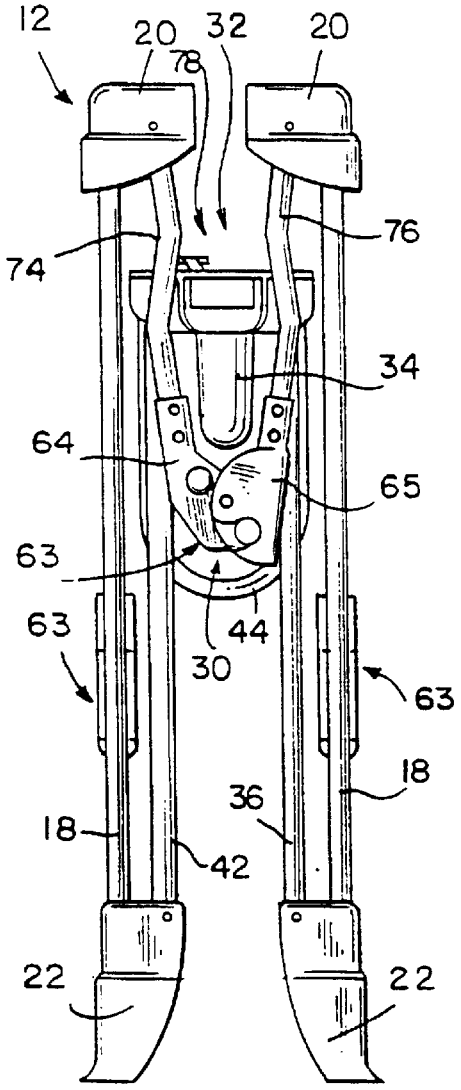
FIG. 8 is an end elevation view of the fully collapsed playyard frame of FIG. 6.
Figure 7:
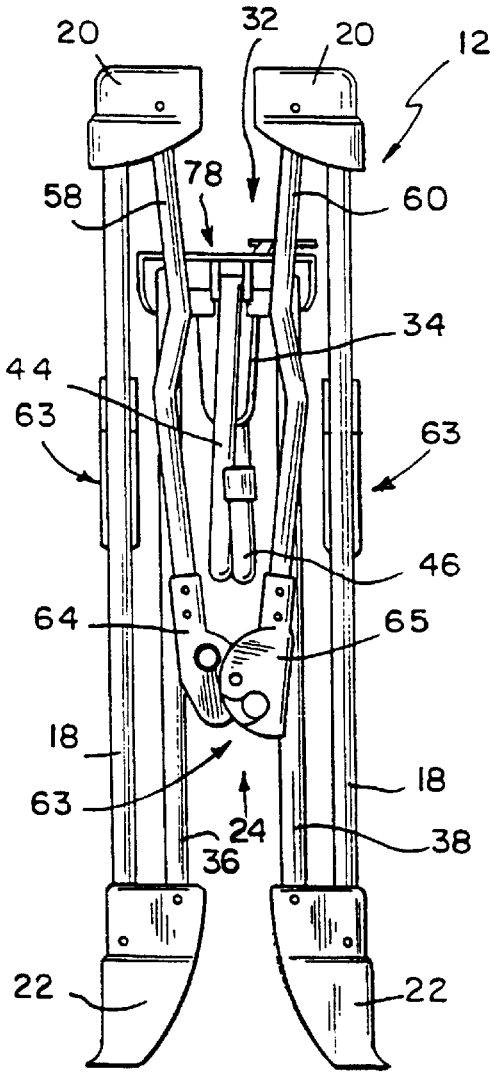
FIG. 7 is a side elevation view of the fully collapsed playyard frame of FIG. 6.

Each of support rails 36, 38, 40, and 42 has an outer end pivotably coupled to one of the corner feet 22 and an inner end pivotably coupled to rail mount 32 so as to facilitate collapsing movement of frame 12 from its erected configuration shown in FIGS. 1–4 to its collapsed configuration shown in FIGS. 6–8. Each of auxiliary support rails 44 and 46 has an inner end pivotably coupled to rail mount 32 and an outer end formed to define a rail support foot 56 as shown, for example, in FIGS. 1 and 4. Once assembled, support rails 36, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

Figure 2:
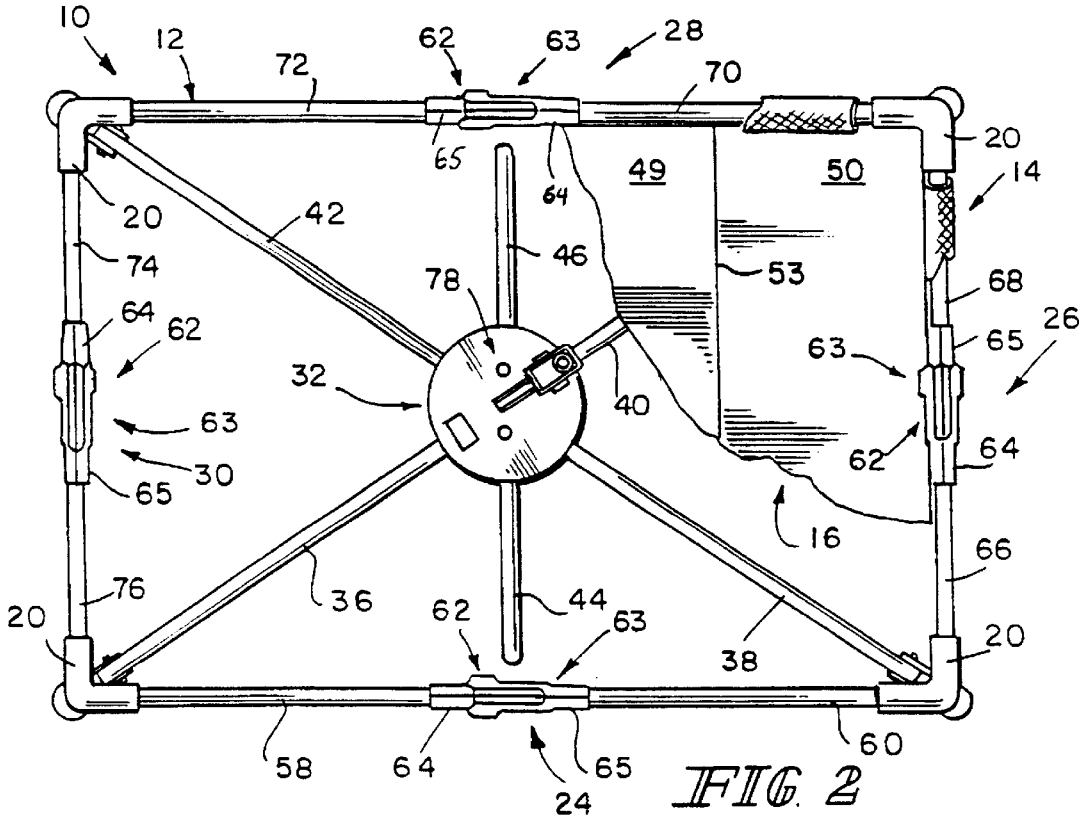
FIG. 2 is a top plan view of the playyard of FIG. 1, with portions broken away, showing an arrangement of six support rails pivotably coupled to a rail mount and positioned to underlie and support the floor mat now installed in the frame and showing four top rails arranged in a rectangular pattern above and around the support rails, each top rail including left and right rail segments and a releasable segment lock.
Figure 3:
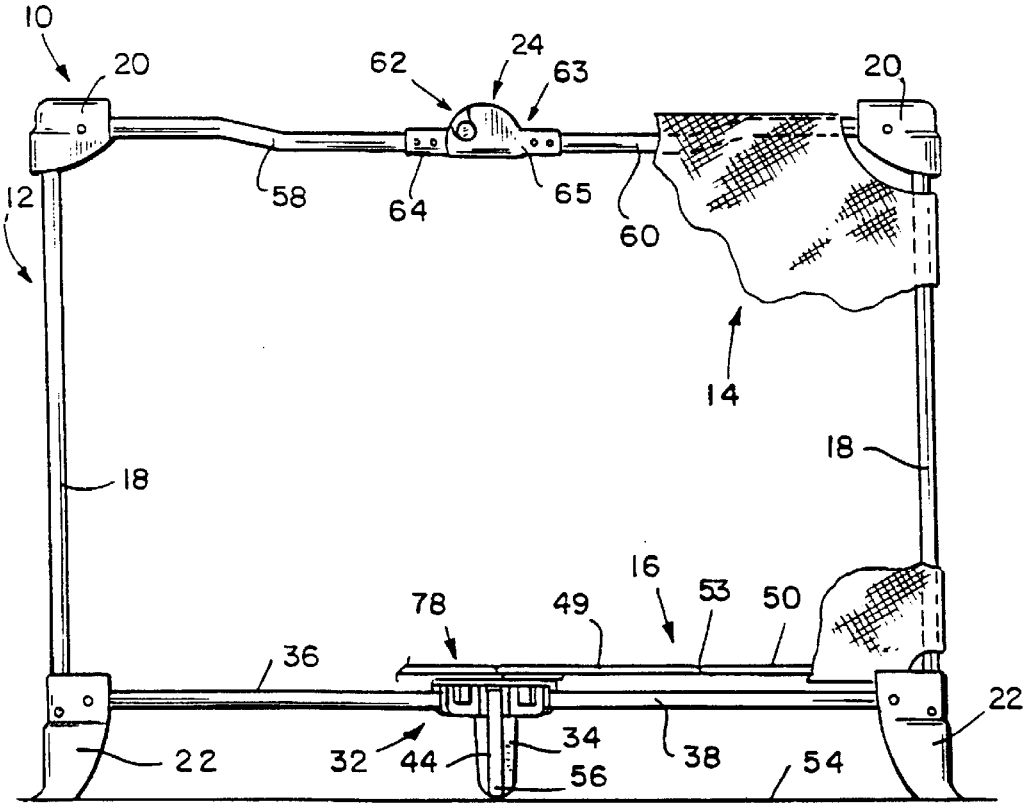
FIG. 3 is a side elevation view of the playyard of FIG. 2 showing a foot appended to the underside of the rail mount to support the rail mount in an elevated position above the ground underlying the floor mat.
Figure 4:
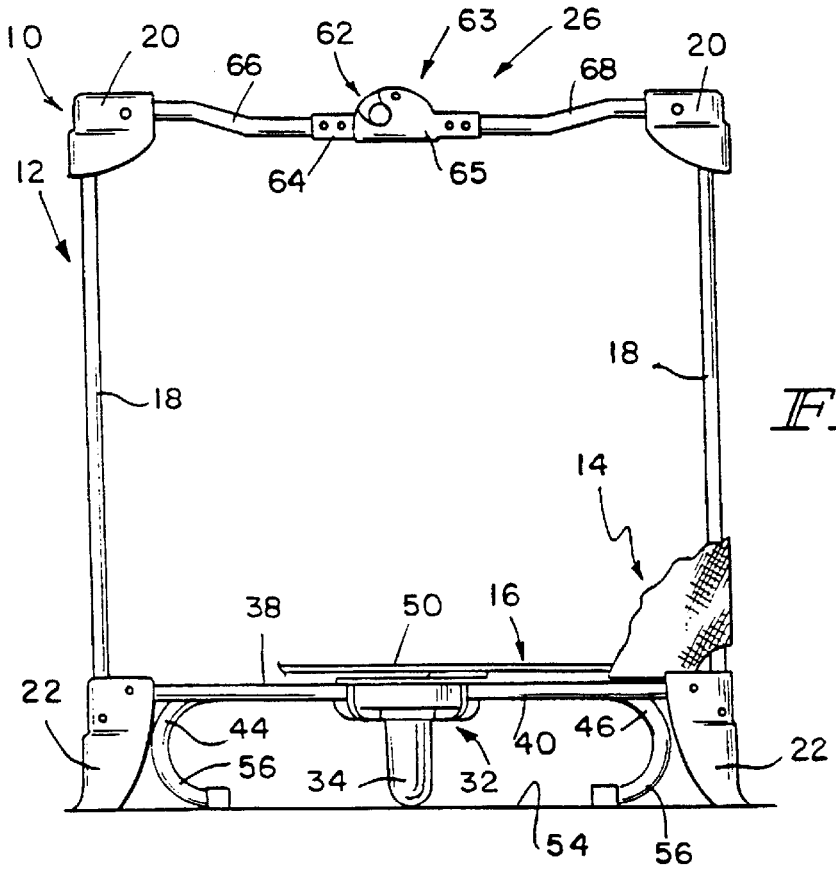
FIG. 4 is an end elevation view of the playyard of FIGS. 2 and 3.

Front top rail 24 includes a left rail segment 58 pivotably coupled to one of the corner pieces 20, a right rail segment 60 coupled for pivotable movement relative to left rail segment 58 (in, for example, the manner described below) and to an adjacent corner piece 20, and a releasable segment lock 62 configured and mounted to "lock" the left and right rail segments 58, 60 together in an in-line relation one to another as shown, for example, in FIGS. 1–3 upon movement of frame 12 to its erected configuration.

Releasable segment lock 62 is mounted in a two-piece lock housing 63 having a left portion 64 rigidly coupled to left rail segment 58 and a right portion 65 rigidly coupled to right rail segment 60 and pivotably coupled to left portion 64. It is within the scope of this disclosure to form left rail segment 58 and left portion 64 as a single piece and to form right rail segment and right portion 65 as a single piece.

Each of right-side top rail 26, rear top rail 28, and left-side top rail is similar in structure to front top rail 24 in that each includes a two-piece lock housing 63 containing a releasable segment lock 62. Right-side top rail 26 includes a left rail segment 66 pivotably coupled to one of the corner pieces 20 and rigidly coupled to a left portion 64 of a second lock housing 63 and a right rail segment 68 pivotably coupled to an adjacent corner piece 20 and rigidly coupled to a right portion 65 of the second lock housing 63. Rear top rail 28 includes a left rail segment 70 pivotably coupled to one of the corner pieces 20 and rigidly coupled to a left portion 64 of a third lock housing 63 and a right rail segment 72 pivotably coupled to an adjacent corner piece 20 and rigidly coupled to a right portion 65 of the third lock housing 63. Left-side top rail 30 includes a left rail segment 74 pivotably coupled to one of the corner pieces 20 and rigidly coupled to a left portion 64 of a fourth lock housing 63 and a right rail segment 76 pivotably coupled to an adjacent corner piece 20 and rigidly coupled to a right portion 65 of the fourth lock housing 63.

A releasable rail lock apparatus 78 is provided in rail mount 32 and configured to lock stationary end pieces mounted on the inner ends of certain of the support rails 36, 38, 40, 42 to rail mount 32 when frame 12 is in its erected configuration as shown in FIG. 1. In the illustrated embodiment, rail lock apparatus 78 is configured to engage stationary end pieces mounted on the inner ends of each of support rails 36, 40 and thereby block pivoting movement of the support rails 36, 40 relative to rail mount 32 when frame 12 is in its erected configuration as shown in FIG. 1 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIG. 5 during controlled collapse of frame 12.

Figure 5:
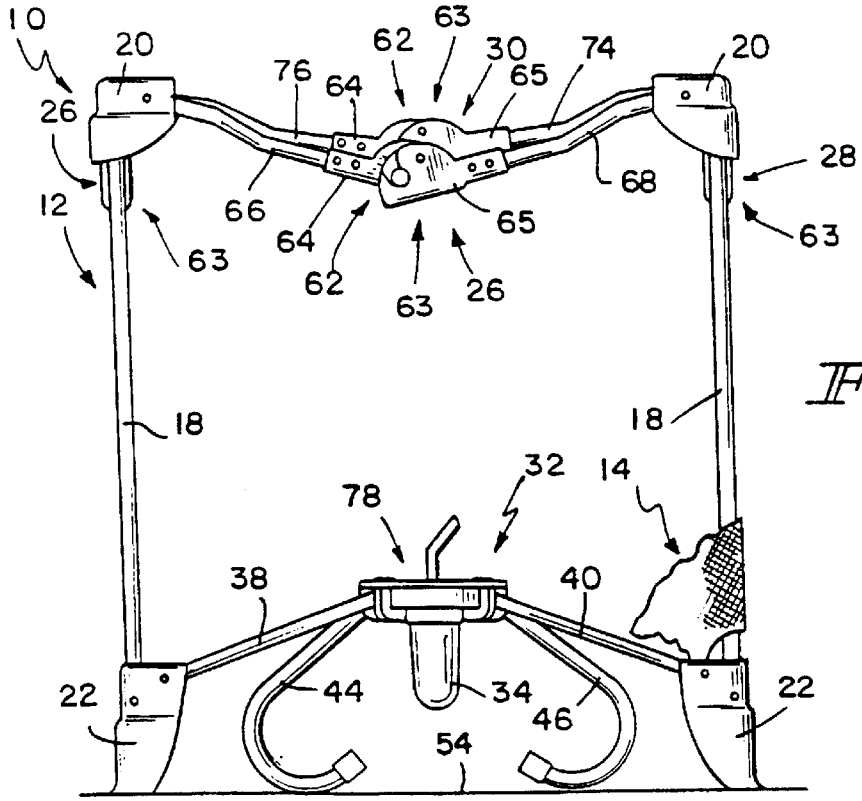
FIG. 5 is a view similar to FIG. 4 of the playyard as it is being collapsed and following unlocking of the rail mount from certain of the pivotable support rails and upward movement of the rail mount away from the ground underlying the playyard (and pivoting movement of the support rails relative to the rail mount) and then release of the segment locks in each of four top rails to allow relative movement of left and right rail segments in each of the four top rails toward collapsed positions.

Referring now to FIGS. 1 and 5, playyard 10 can be collapsed by removing floor mat 16, manually actuating releasable rail lock apparatus 78 and then raising rail mount 32 away from ground 54 to collapse support rails 36, 38, 40, 42, 44, 46 partially, and then manually actuating each of the four releasable segment locks 62 to collapse top rails 24, 26, 28, 30 partially. Then frame 12 can be collapsed further to assume a fully collapsed configuration shown, for example, in FIGS. 6–8. Finally, if desired, floor mat 16 can be wrapped around collapsed frame 12 and secured using suitable means to provide a storage case or carrying case for collapsed frame 12.

Figure 9:
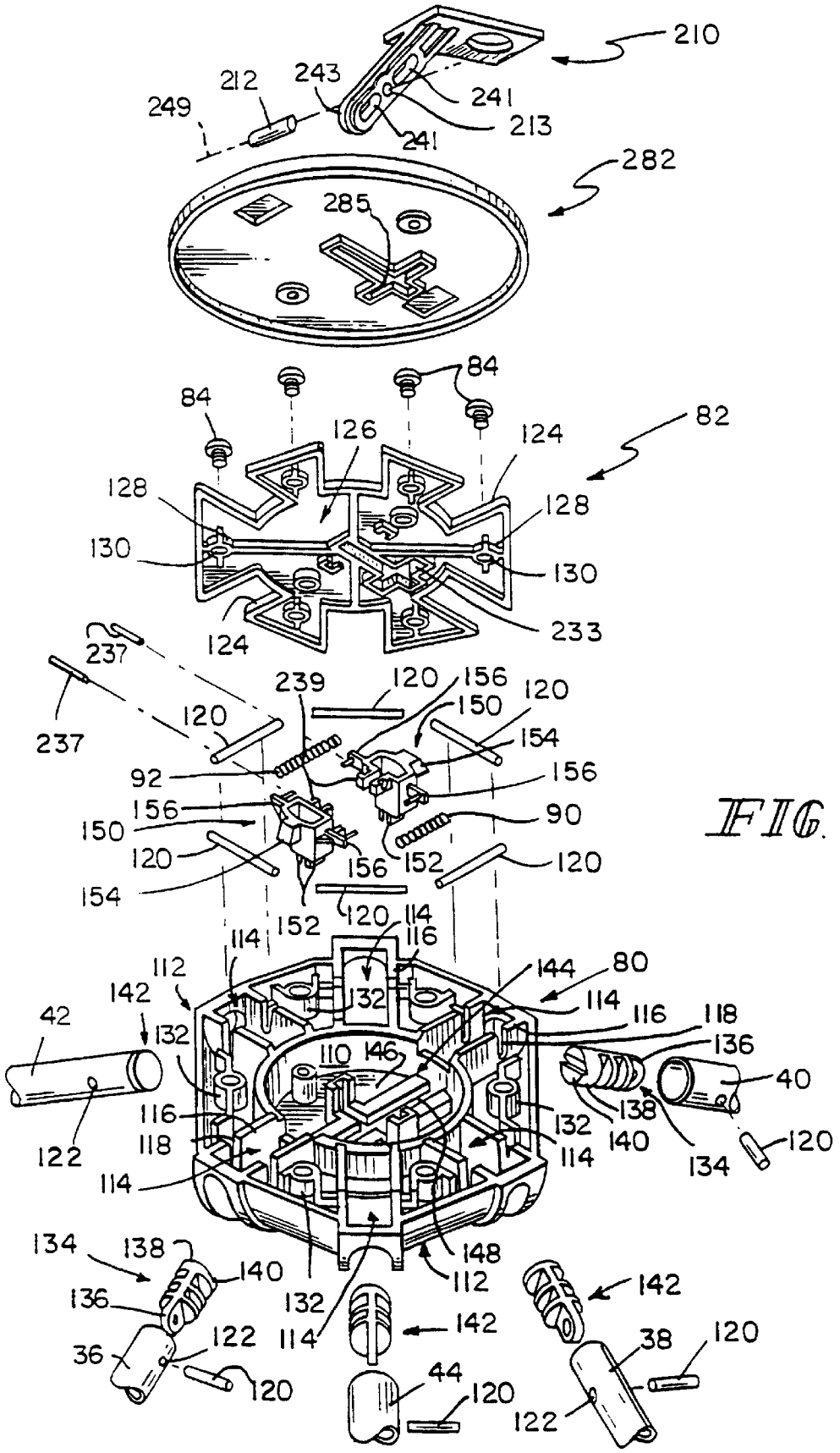
FIG. 9 is an exploded perspective view of the rail mount of FIGS. 1–8 showing a base for receiving the pivotable support rails, a rail pivot post for each support rail, and a lever-actuated rail lock apparatus including a pair of slidable rail locks and a pair of lock springs, a lever adapted to be pivotably coupled to the base about a horizontal pivot axis and to be coupled to each of the slidable rail locks, inner and outer rail mount cover plates, and plate fasteners for securing the cover plates to the rail mount, and showing end pieces coupled to each of the support rails so that the end pieces do not move relative to the support rails wherein two of the stationary end pieces are configured to include arm catches sized to be engaged by lock arms included in the two rail locks to lock the two support rails carrying such end pieces to the rail mount so as to block pivoting movement of those (and others of the) support rails relative to the rail mount once the playyard frame is moved to assume its fully erect configuration.

One embodiment of rail mount 32 and releasable rail lock 78 is illustrated in FIGS. 9–12. As shown in FIG. 9, rail mount 32 includes a base 80, an inner cover plate 82, an outer cover plate 282, and six plate fasteners 84 and releasable rail lock apparatus 78 includes two movable rail locks 86, 88 and two springs 90, 92 for urging rail locks 86, 88 to move in opposite directions in rail mount 32 to engage and lock support rails 36, 40 against movement relative to rail mount 32. It is within the scope of this disclosure to provide a single cover plate wherein plate 82 is integral with plate 282.

In the embodiment of FIGS. 9–12, a lever 210 is pivotably mounted to rail mount 32 for movement about a horizontal pivot axis 249 and arranged to move rail locks 86, 88 toward one another against springs 90, 92 to release rail locks 86, 88 from locked engagement with the inner ends (e.g. stationary end pieces 134) of support rails 36, 40. In the embodiment of FIGS. 13–16, lever 210 is omitted and rail locks similar to locks 86, 88 are configured and located to be gripped by an operator and "squeeze actuated" to release those rail locks from locked engagement with support rails 36, 40. Other embodiments of rail lock apparatus are shown in FIGS. 17–23.

Base 80 is a molded piece made of a plastics material such as nylon. Base 80 is formed to include a circular inner wall 110, a somewhat hexagonal-shaped outer wall 112, and six rail-receiving channels 114 extending between inner and outer walls 110, 112 as shown, for example, in FIG. 9. Each channel 114 is defined by a pair of interior walls 116 interconnecting circular inner wall 110 and hexagonal-shaped outer wall 112 and lying in spaced-apart parallel relation to one another to provide a space for receiving one of support rails 36, 38, 40, 42, 44, 46 therein.

Each interior wall 116 is formed to include a post-receiving slot 118 for receiving one end of a rail pivot post 120 therein. Rail pivot posts 120 function to couple the inner ends of each of support rails 36, 38, 40, 42, 44, 46 to rail mount 32 for pivotable movement relative to rail mount 32. Each support rail 36, 38, 40, 42, 44, 46 is formed to include post-mounting apertures 122 or other suitable post connectors.

Inner cover plate 82 is formed to include six channel openings 124 for aligning with outer portions of rail-receiving channels 114 once cover plate 82 is attached to base 80. The underside 126 of cover plate 82 is also formed to include six alignment posts 128 formed to extend fastener-receiving apertures 130 extending therethrough. Base 80 is formed to include six post hole members 132 sized to receive and engage the six alignment posts 128 formed on inner cover plate 82 and the six plate fasteners 84 extending through fastener-receiving apertures 130 formed in alignment posts 128. In the embodiment of FIGS. 9–12, cover plate 82 is formed to include a cross-shaped aperture 233 for receiving a portion of lever 210 and a pivot pin 212 associated with lever 210 therein. In the embodiment of FIGS. 13–16, cover plate 382 is also formed to include access apertures 133 to enable a user to gain access to the releasable rail locks 86, 88 mounted within circular inner wall 110 of base 80 underneath cover plate 382.

An outer cover plate 282 is sized and shaped to mount over inner cover plate 82 as shown, for example, in FIGS. 9–12. Outer cover plate 282 is formed to include a cross-shaped aperture 285 for receiving a portion of lever 210 and pivot pin 212 therein. Aperture 285 could be configured to form a recess for receiving an outer portion (handle) 245 of lever 210 therein when lever 210 is pivoted about horizontal pivot axis 249 to a retracted position.

A lockable stationary end piece 134 is coupled to the inner end of each of support rails 36 and 40 so as not to move relative to its companion support rail 36 or 40. Lockable stationary end piece 134 is configured to include a shaft 136 mating with one of support rails 36, 40, a head 138 appended to shaft 136, and an arm catch 140 appended to head 138 and arranged to engage one of rail locks 86, 88 mounted in rail mount 32 once frame 12 is moved to assume its erected configuration. A stationary end piece 142 including a mounting shaft and a head appended to the mounting shaft is coupled to the inner end of each of support rails 38, 42, 44, and 46.

Rail mount 32 is formed to include apparatus mounted inside circular inner wall 110 for supporting and guiding the two rail locks 86, 88 as they move to engage and disengage arm catches 140 formed on stationary end pieces 134. Rail lock guide 144 is appended to inner wall 110 and a floor 146 and arranged to extend across the diameter of circular inner wall 110 from the rail-receiving channel 114 containing lockable support rail 36 to the rail-receiving channel containing the diagonally spaced-apart lockable support rail 40. Rail lock guide 144 includes one or more guide channels 148 for receiving guide arms 152 included in rail locks 86, 88.

Figure 16:
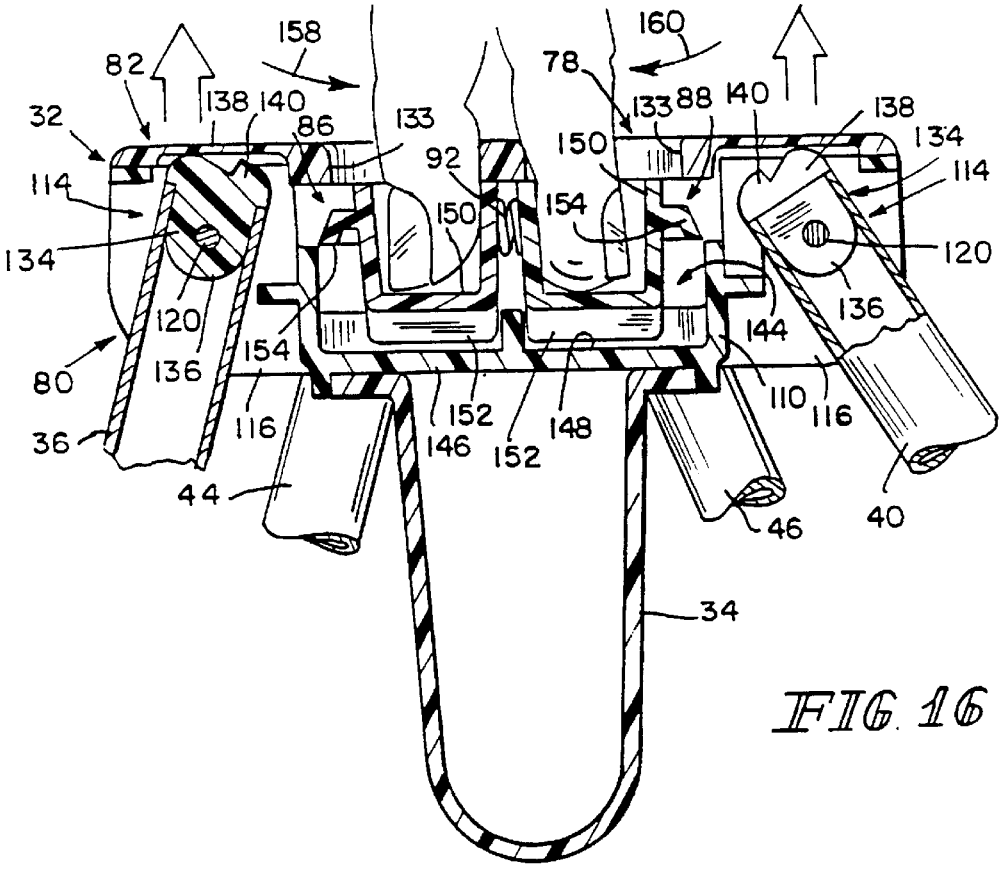
FIG. 16 is a view similar to FIG. 15 showing manual operation of the squeeze-actuated lock mechanism to disengage lock arms of the slidable rail locks from the stationary arm catches on two of the support rails and showing pivoting movement of the support rails about the rail pivot posts relative to the rail mount following disengagement of the rail locks and the support rail arm catches.

Each rail lock 86, 88 includes a lock body 150, a pair of guide arms (e.g., flat blades) 152 appended to underside of lock body 150 and positioned to lie in spaced-apart parallel relation one to another, and a lock arm 154. Each rail lock 86, 88 in the embodiment of FIGS. 13–16 is also formed to include a finger-receiving chamber 155 accessible to a user through one of access apertures 133 formed in cover plate 82 as shown in FIG. 16. Lock arm 154 is configured and arranged to engage (e.g., lock onto) the arm catch 140 formed on a companion support rail end piece 36, 40 once the frame 12 moves to assume its erected configuration. Each rail lock 86, 88 further includes a pair of spread-apart stabilizer arms 156 appended to opposite sides of lock body 150 and configured to support and engage distal ends of springs 90, 92.

Figure 10:
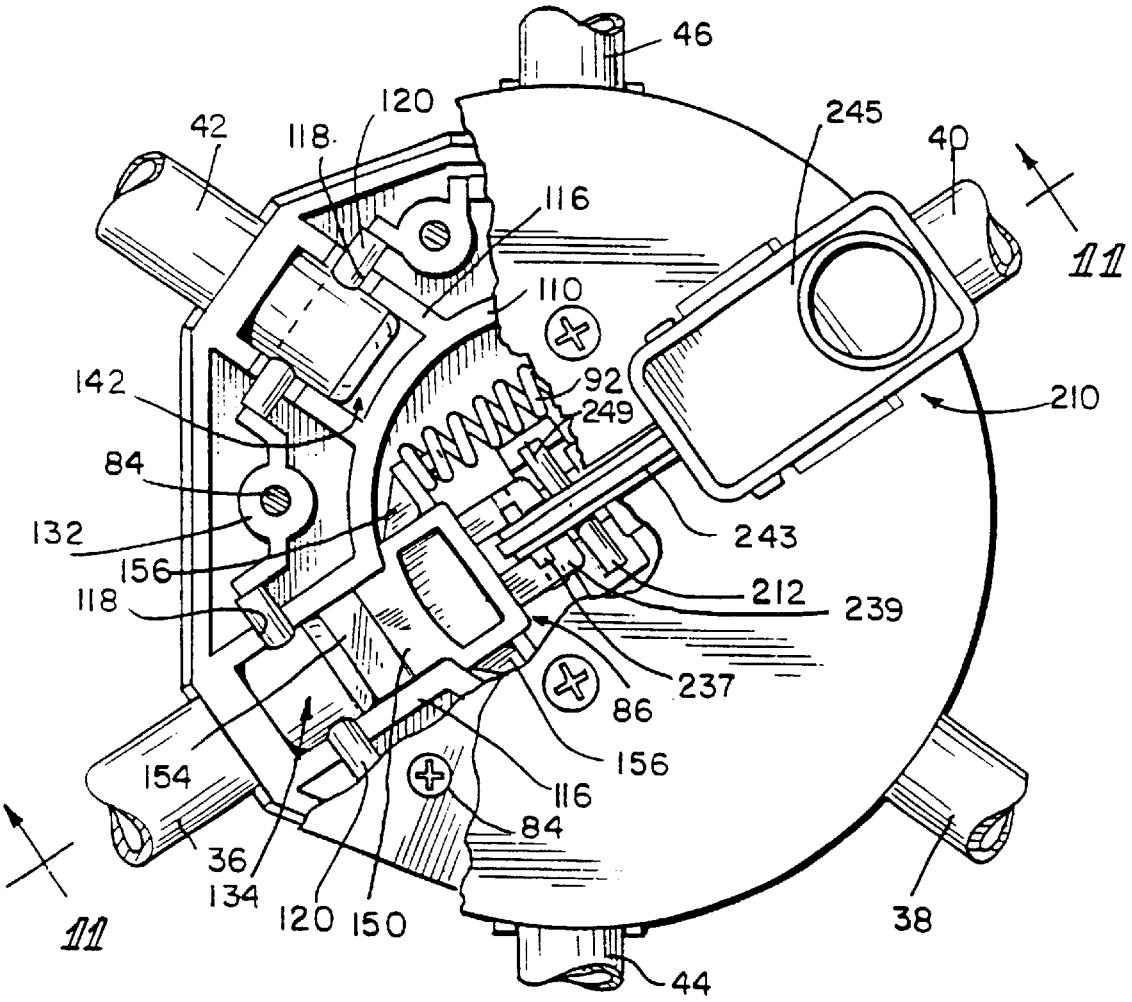
FIG. 10 is an enlarged top plan view of the rail mount of FIG. 9 after it has been fully assembled as shown in FIG. 1.
Figure 11:
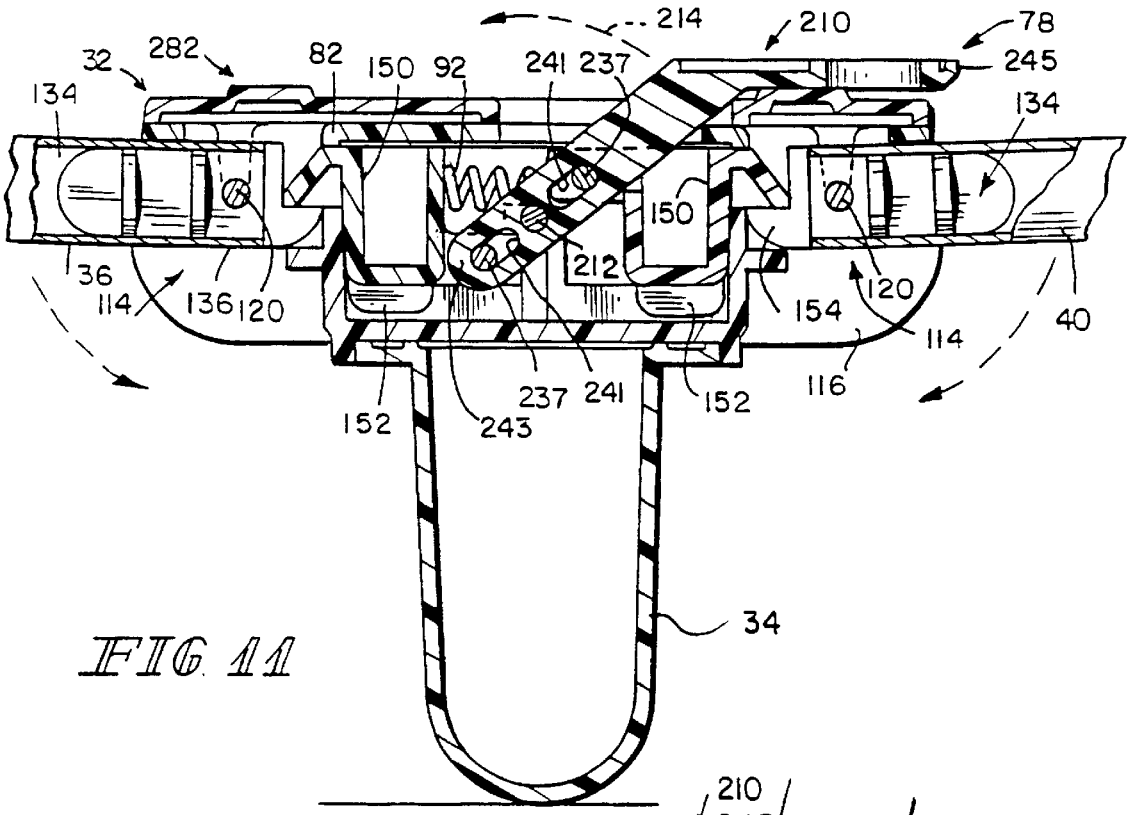
FIG. 11 is a sectional view taken along line 11—11 of FIG. 10 showing the two diagonally spaced-apart rail locks biased by the lock springs to locking positions engaging the arm catches of the two specially configured support rail end pieces and showing the lever arranged in a retracted position wherein an outer end of the lever lies adjacent to the rail mount cover plate.
Figure 12:
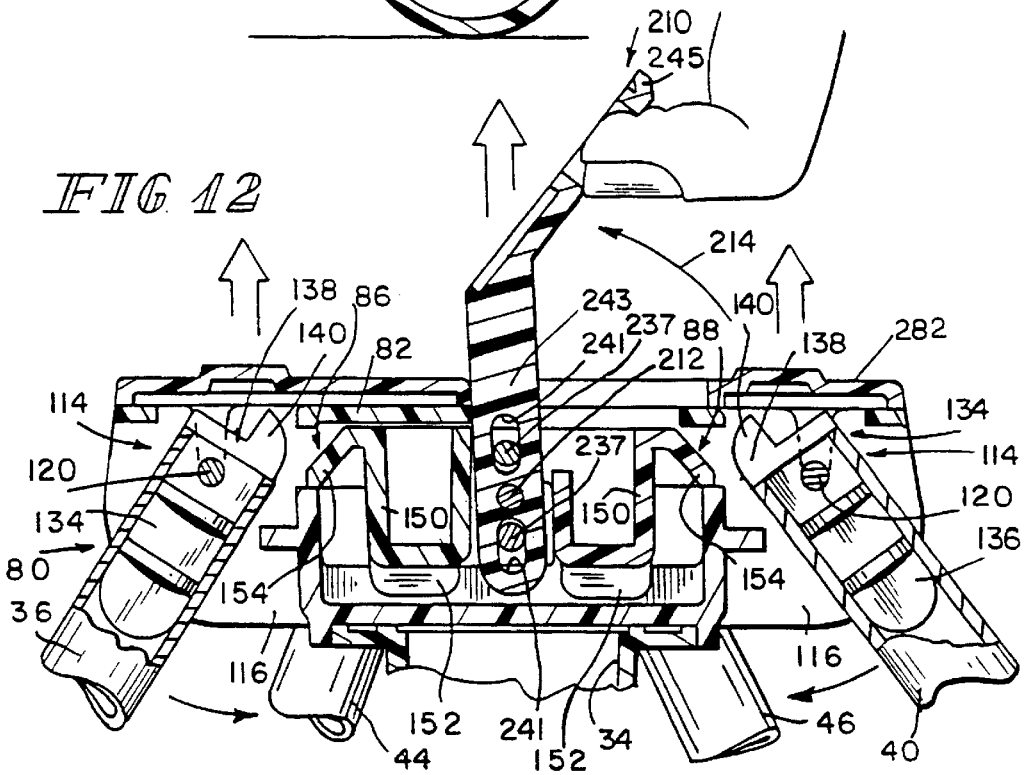
FIG. 12 is a view similar to FIG. 11 showing manual operation of the lever-actuated lock mechanism to disengage lock arms of the slidable rail locks from the non-moving arm catches on two of the support rails and showing pivoting movement of the support rails about the rail pivot posts relative to the rail mount following disengagement of the rail locks and the support rail arm catches and showing the lever pivoted about the horizontal pivot axis in a counterclockwise direction to a projected position away from the rail mount cover plate.

In the embodiment of FIGS. 9–12, each rail lock 86, 88 further includes a pin 237 coupled to a pin mount 239 appended to lock body 150 of the rail lock 86 or 88. As shown in FIGS. 10–12, each pin 237 will fit into a slot 241 formed in an inner end 243 of lever 210. The slots 241 are positioned to lie in spaced-apart relation to position pivot pin 212 therebetween as shown in FIGS. 11 and 12. Pivot pin 212 fits into aperture 213 formed in inner end 243 of lever 210 as shown in FIG. 9 and is mounted in rail mount 32 to establish horizontal pivot axis 249.

Operation of rail locks 86, 88 to release support rails 36, 40 from locking engagement with rail mount 32 is shown, for example, in FIGS. 11 and 12. As shown in FIG. 11 (and in FIG. 15), springs 90, 92 urge rail locks 86, 88 in opposite directions to cause lock arms 154 to engage the lockable end pieces 134 coupled to support rails 36, 40. To release rail locks 86, 88 in the lever-actuated releasable rail lock apparatus 78 shown in FIGS. 9–12, lever 210 is pivoted by a user in counterclockwise direction 214 (as shown in FIG. 12) about pivot pin 212 to move rail locks 86, 88 toward one another against springs 90, 92 to disengage lock arms 154 from stationary arm catches 140. To release rail locks 86, 88 in squeeze-actuated releasable rail lock apparatus 278 shown in FIGS. 13–16, a user inserts two fingers into finger-receiving chambers 155 formed in lock bodies 150 and then moves those fingers toward one another in directions 158, 160 (as shown in FIG. 16) to "squeeze" springs 90, 92 and disengage lock arms 154 from arm catches 140. Rail mount 32 can then be lifted upwardly away from underlying ground 54 to initiate collapse of collapsible frame 12 in, for example, the manner described above.

Figure 18:
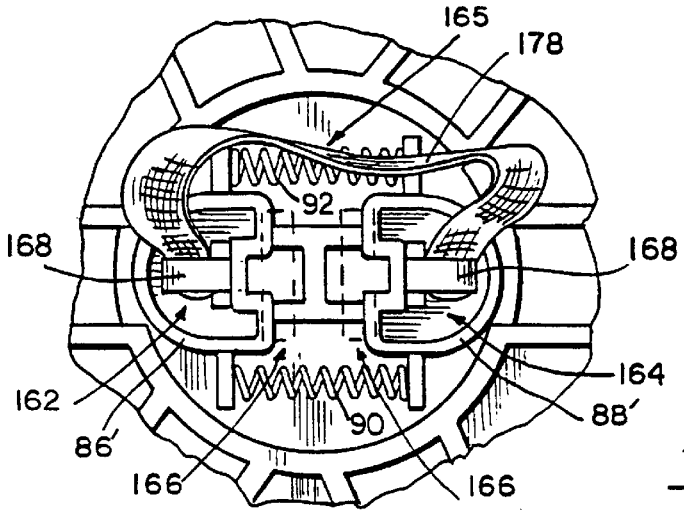
FIG. 18 is a top plan view of a portion of the assembly shown in FIG. 17 showing the strap and the upper end of each drive member positioned to lie in the finger-receiving chamber of one of the rail locks.
Figure 17:
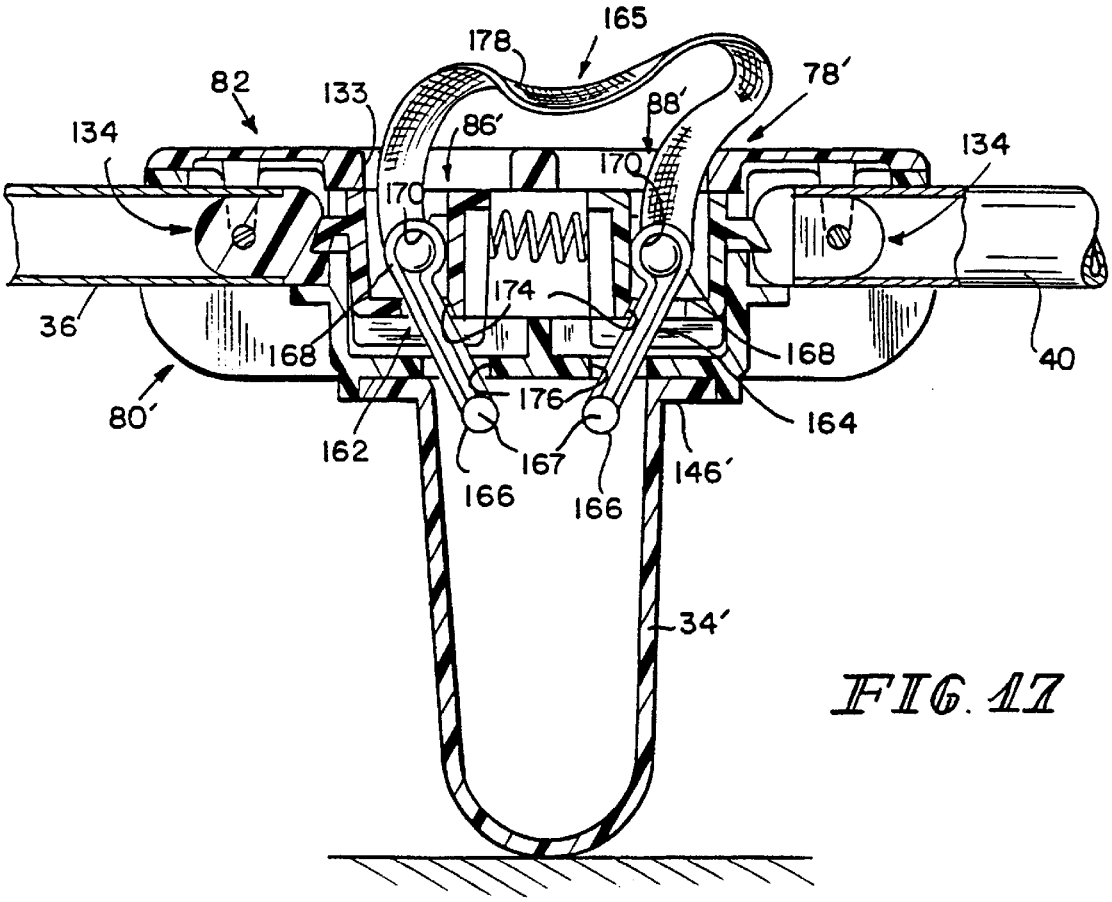
FIG. 17 is a view similar to FIG. 11 of still another embodiment of a releasable rail lock apparatus showing a pull-type actuator that is operable to move the two spring-biased rail locks toward one another to support rail-disengaging positions, the pull-type actuator including a pair of drive members and a strap coupled to the drive members, each drive member having a lower end pivotably coupled to the rail mount and an upper end extending into the finger-receiving chamber and connecting to the strap.
Figure 19:
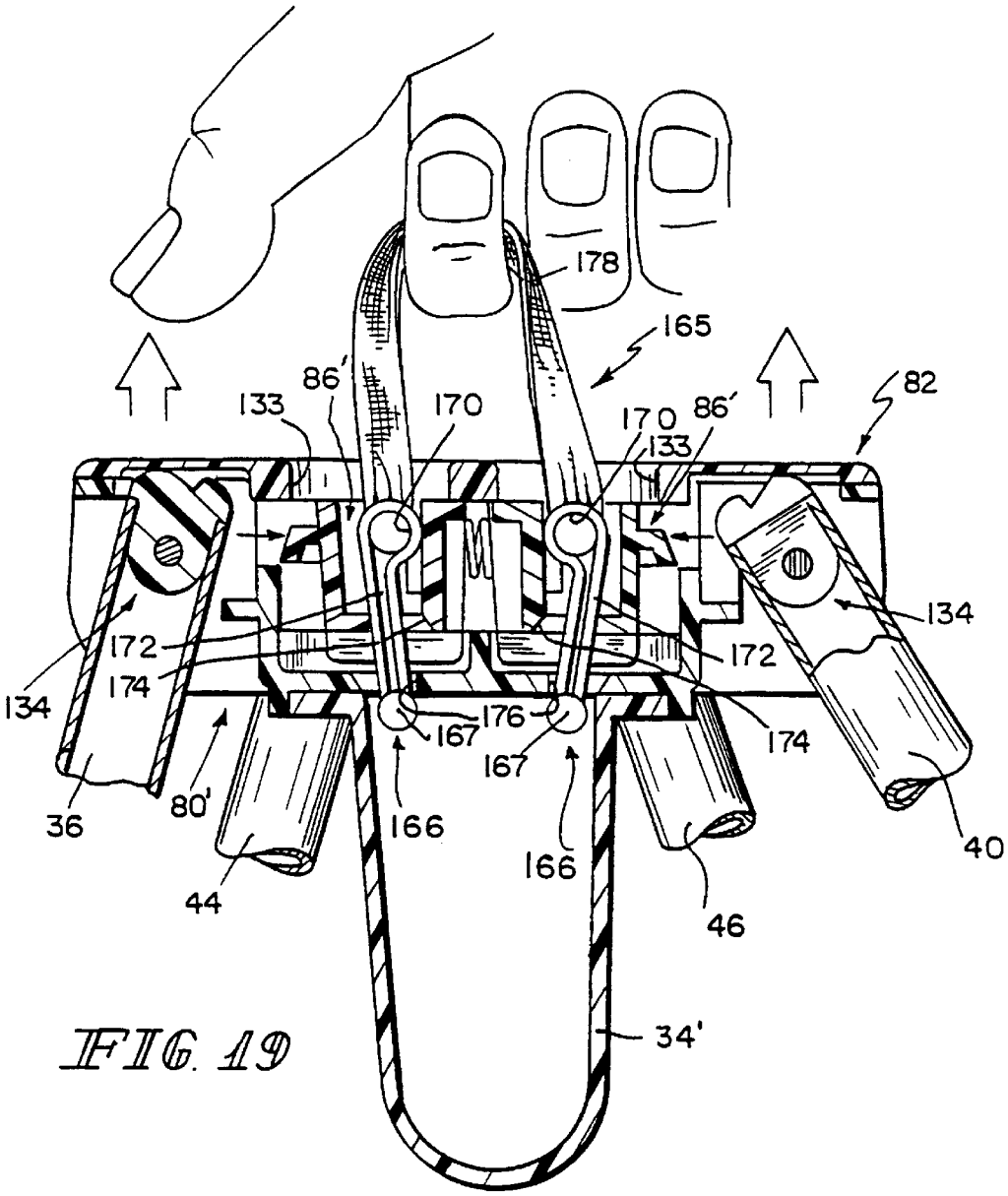
FIG. 19 is a view similar to FIG. 17 showing manual upward lifting of a portion of the strap to pivot the two drive members relative to the rail mount causing retraction of the two rail locks to support rail-disengaging positions.
Figure 20:
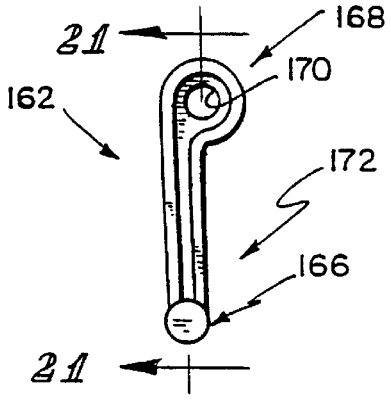
FIG. 20 is an enlarged side elevation view of the drive member shown in FIGS. 17–19.
Figure 21:
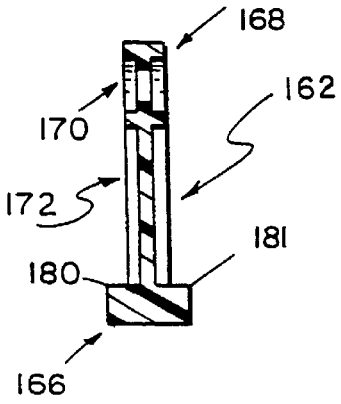
FIG. 21 is a sectional view taken along line 21—21 of FIG. 20 showing a T-shaped base and a strap-engaging tip of the drive member.

Another embodiment of the rail mount and releasable rail lock is shown in FIGS. 17–19. As shown in FIG. 17, releasable rail lock 78' is configured to include a pair of drive members 162, 164 coupled to rail mount 32' and arranged to be moved relative to rail mount 32' by a strap 165 (or other grippable member) to cause rail locks 86', 88' to retract to disengage lockable end pieces 134 of support rails 36, 40.

Figure 13:
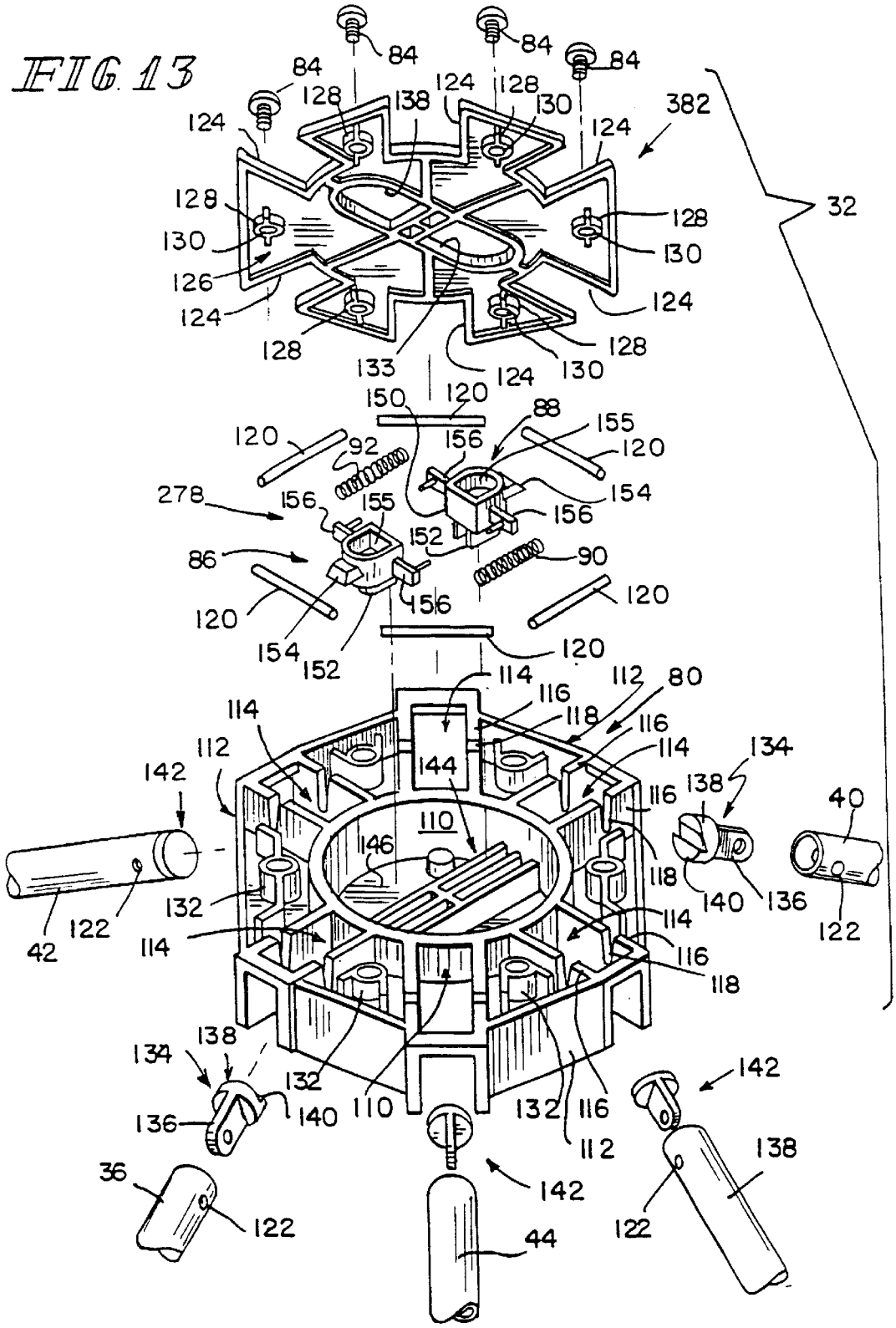
FIG. 13 is an exploded perspective view of another embodiment of a rail mount suitable for use in the frame of FIGS. 1–8 showing a base for receiving the pivotable support rails, a rail pivot post for each support rail, and a squeeze-actuated lock mechanism including a pair of slidable rail locks and a pair of lock springs, a rail mount cover plate, and plate fasteners for securing the cover plate to the rail mount, and showing end pieces coupled to each of the support rails so that the end pieces do not move relative to the support rails wherein two of the stationary end pieces are configured to include arm catches sized to be engaged by lock arms included in the two rail locks to lock the two support rails carrying such end pieces to the rail mount so as to block pivoting movement of those (and others of the) support rails relative to the rail mount once the playyard frame is moved to assume its fully erect configuration.
Figure 14:
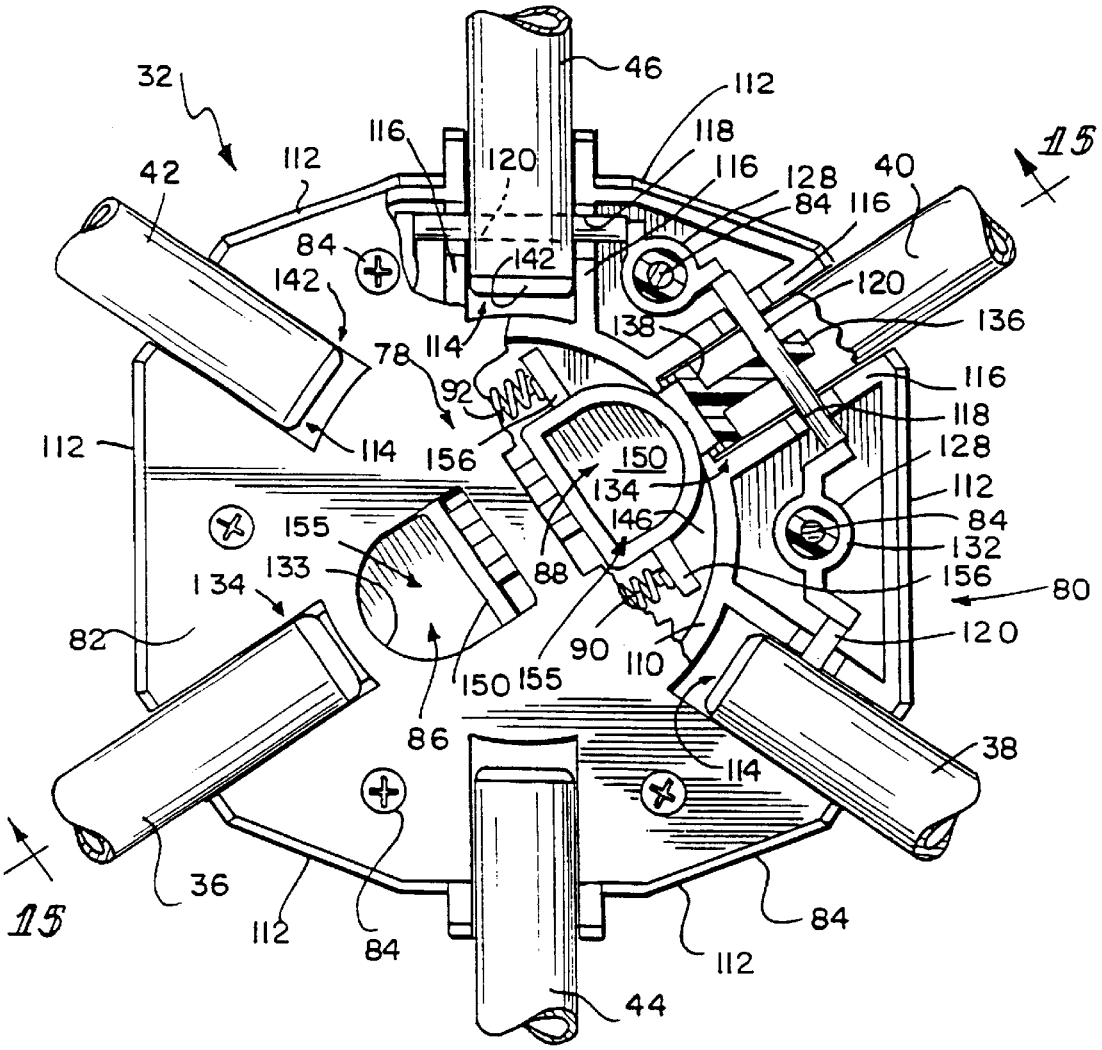
FIG. 14 is an enlarged top plan view of the rail mount of FIG. 13 after it has been fully assembled in a manner similar to that shown in FIG. 1.
Figure 15:
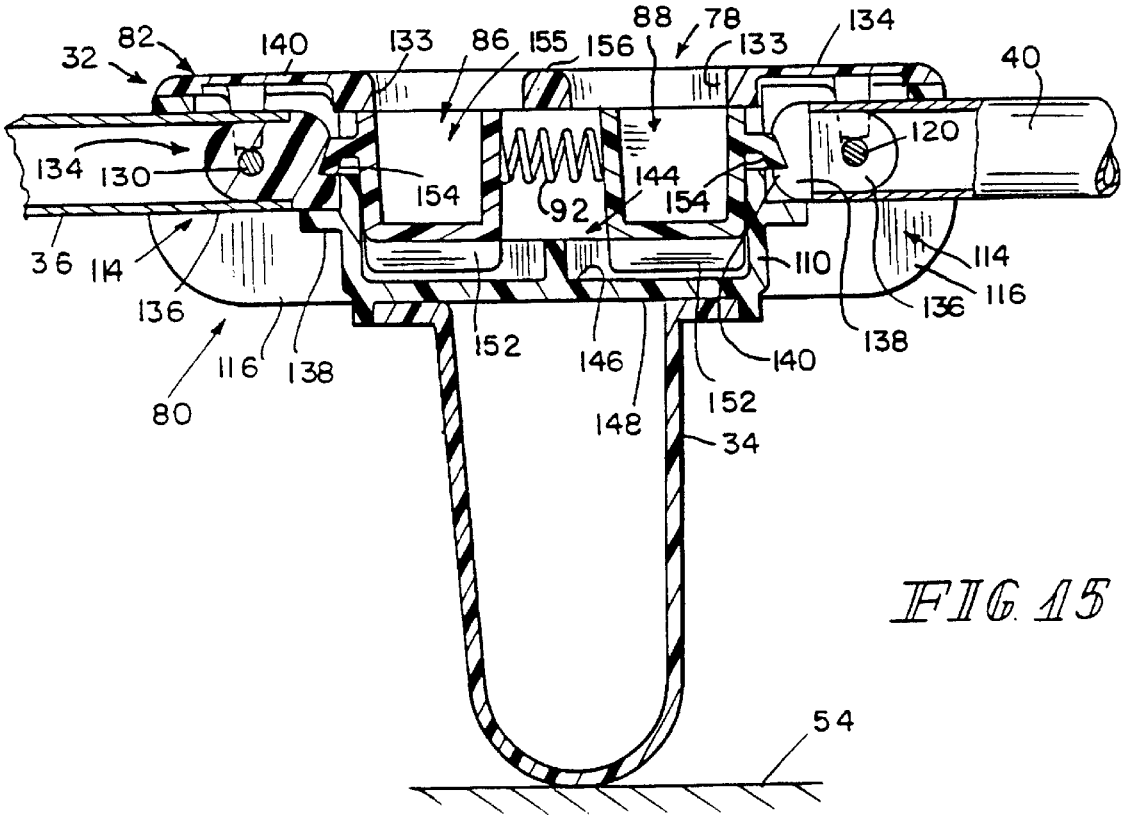
FIG. 15 is a sectional view taken along line 15—15 of FIG. 14 showing the two diagonally spaced-apart rail locks biased by the lock springs to locking positions engaging the arm catches of the two specially configured support rail end pieces.

In the illustrated embodiment, a lower end 166 of each drive member 162, 164 is pivotably coupled to a portion of foot 34' for movement about axis 167 and an upper end 168 of each drive member 162, 164 is positioned to lie in one of the finger-receiving chambers 155 of rail locks 86', 88'. Alternatively, lower end 166 could be pivotably coupled to rail mount base 80. Upper end 168 is formed to include an aperture 170 (or other suitable means) for connecting to one portion of strap 165. A middle segment 172 of each drive member 162, 164 is arranged to extend through an opening 174 formed in rail lock 86', 88' and an opening 176 formed in floor 146' of rail mount 32'. As shown in FIGS. 13 and 14, strap 165 extends through access apertures 133 formed in cover plate 82 so that a bight portion 178 of strap 165 is accessible to a user once floor mat 16 has been removed from playyard 10 to expose rail mount 32.

In use, a user grips strap 165 at bight 178 and lifts upwardly as shown in FIG. 19. This action on strap 165 causes drive members 162, 164 to pivot about pivot axes 167 so that upper ends 168 of drive members 162, 164 move toward one another to engage rail locks 86', 88' and move those rail locks 86', 88' toward one another to support rail-disengaging positions. Lower end 166 of each drive member 162, 164 is T-shaped to define pivot posts 180, 181.

Figure 22:
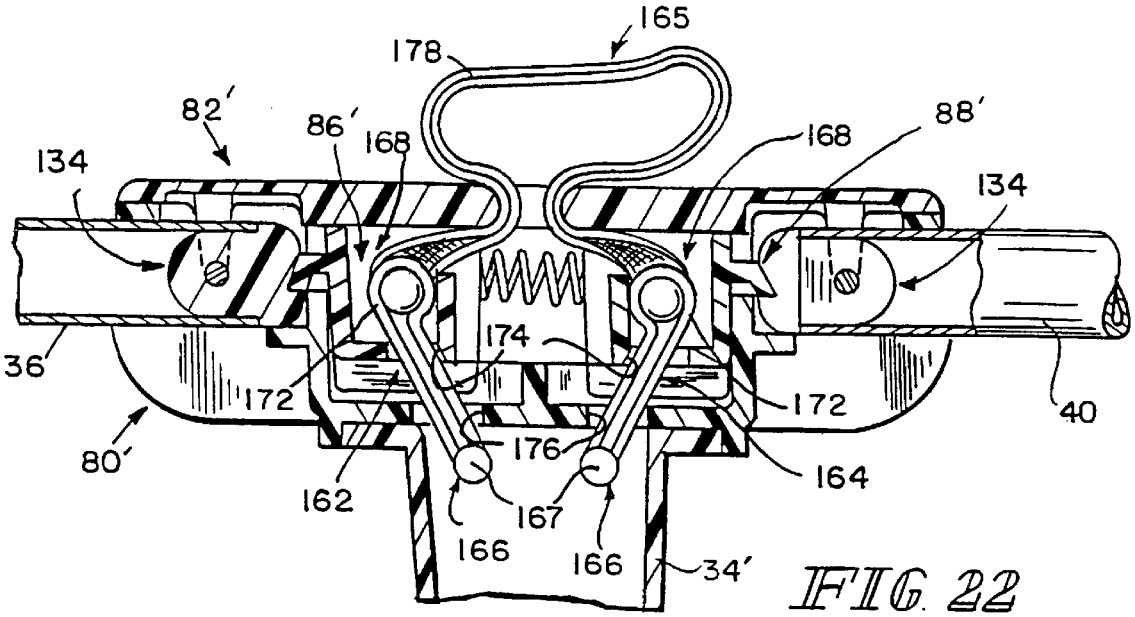
FIG. 22 is a view similar to FIG. 17 showing yet another embodiment of a releasable rail lock apparatus wherein the two rail locks are biased to support rail-engaging positions.
Figure 23:
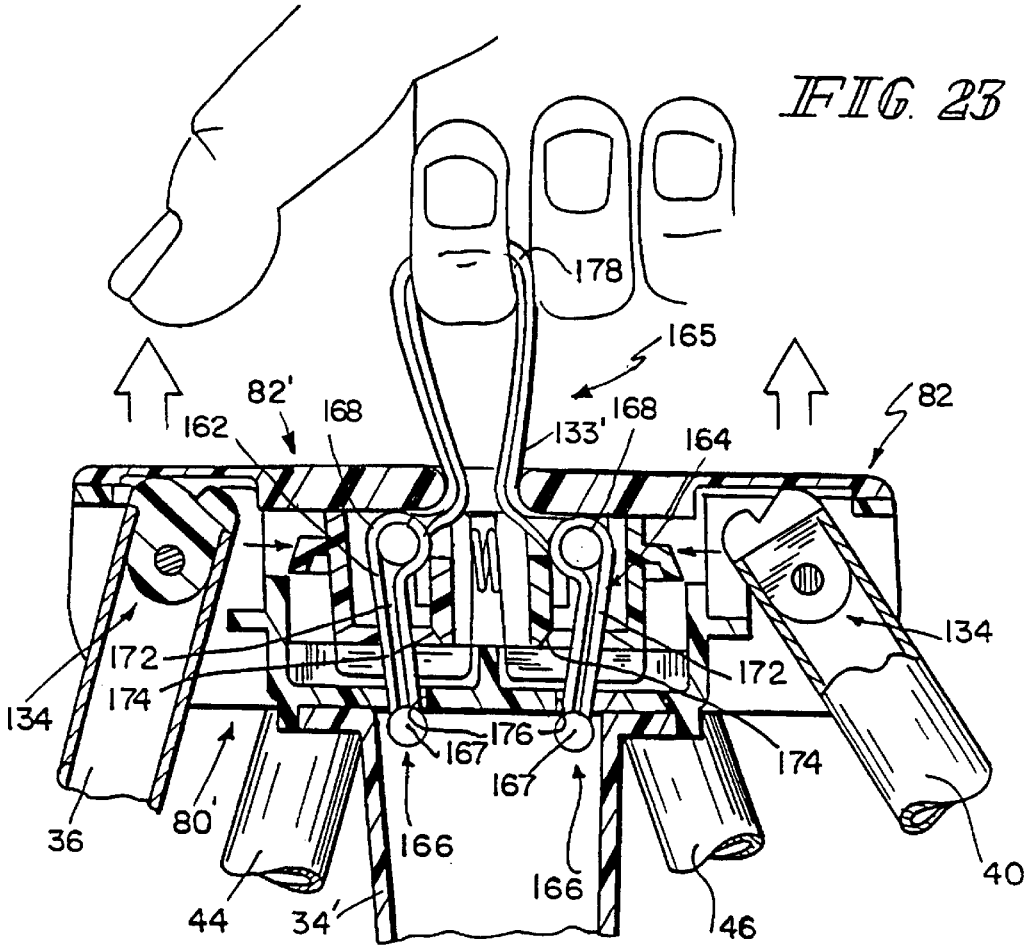
FIG. 23 is a view similar to FIG. 22 showing manual upward lifting of a portion of the strap to pivot the two drive members causing retraction of the two rail locks to support rail-disengaging positions.

Yet another embodiment of the rail mount and releasable rail lock is shown in FIGS. 22 and 23. In this embodiment, cover plate 82' is formed to include only a single strap-receiving aperture 133' rather than the two access apertures 133 as shown in the previous embodiments. The ends of strap 165 are passed through aperture 133' and connected to upper ends 168 of drive members 162, 164 leaving bight 178 of strap 165 above and outside of the aperture 133' formed in cover plate 82'.

Although the invention has been described in detail with reference to certain preferred embodiments, variations and modifications exist within the scope and spirit of the invention as described and defined in the following claims.

What is claimed is:

1. A playyard floor support frame comprising a rail mount, at least two floor support rails, each floor support rail including an inner end pivotably coupled to the rail mount to enable each floor support rail to be moved relative to the rail mount about a rail pivot axis between an erected configuration adapted to support a floor mat on the floor support rails and above the rail mount and a collapsed configuration adapted to facilitate storage of the floor support frame, and a rail lock apparatus coupled to the rail mount, the rail lock apparatus including a rail lock mounted for movement in the rail mount and configured to latch onto a stationary end piece mounted on the inner end of a selected floor support rail and to block pivoting movement of the selected floor support rail relative to the rail mount about the rail pivot axis to lock the selected floor support rail to the rail mount upon movement of the floor support rails relative to the rail mount to the erected configuration.

2. The frame of claim 1, wherein the rail mount includes a base and the rail lock apparatus includes two rail locks mounted for movement in the base between engaged positions engaging and locking selected floor support rails against movement relative to the base to establish the erected configuration and released positions unlocking the selected floor support rails to allow pivotable movement of the selected floor support rails about the rail pivot axes to the collapsed configuration.

3. The frame of claim 2, wherein the rail lock apparatus further includes means for yieldably biasing each rail lock to the engaged position.

4. The frame of claim 2, wherein the rail lock apparatus further includes a lever pivotably coupled to the base for movement about a horizontal pivot axis between locked and unlocked positions and the lever is coupled to the two rail locks and configured to move the two rail locks toward one another to assume the released positions in response to pivoted movement of the lever relative to the base about the horizontal pivot axis of the lever.

5. The frame of claim 4, wherein the rail lock apparatus further includes means for yieldably biasing each rail lock to the engaged position.

6. The frame of claim 4, wherein the rail lock apparatus further includes a cover plate mounted on the base and arranged to overlie the two rail locks and the lever includes an inner end pivotably coupled to the base at the horizontal pivot axis of the lever and slidably coupled to each of the two rail locks and an outer end movable about the horizontal pivot axis of the lever from a retracted position lying adjacent to the cover plate when the two rail locks are moved to assume their locked positions to a projected position away from the cover plate when the two rail locks are moved to assume their unlocked positions.

7. The frame of claim 4, wherein the lever is formed to include first and second slots and the slots are located to position the horizontal pivot axis of the lever therebetween, a first of the rail locks includes a first lock body, a first lock arm coupled to the first lock body and configured to engage the inner end of one of the selected floor support rails upon movement of the rail locks to the locked positions, and a first pin coupled to the first lock body and arranged to extend into the first slot formed in the lever, and a second of the rail locks includes a second lock body, a second lock arm coupled to the second lock body and configured to engage the inner end of another of the selected floor support rails upon movement of the rail locks to the locked positions, and a second pin coupled to the second lock body and arranged to extend into the second slot formed in the lever.

8. The playyard floor support frame of claim 1, wherein the rail lock apparatus further includes means for yieldably biasing the rail lock to the engaged position.

9. The playyard floor support frame of claim 8, wherein the means for yieldably biasing the rail lock to the engaged position is a compression spring.

10. The playyard support frame of claim 1, wherein the rail lock apparatus further includes a lever pivotably coupled to the rail mount for movement about a horizontal pivot axis between locked and unlocked positions and the lever is slidably coupled to the rail lock to move the rail lock relative to the rail mount to a released position unlocking the selected floor support rail from the rail mount.

11. The playyard support frame of claim 1, wherein the rail mount includes a base and at least one rail pivot post, one of the rail pivot posts is coupled to the base and to the inner end of the selected floor support rail to establish said rail pivot axis and the stationary end piece includes a shaft coupled to the inner end of the selected floor support rail, a head appended to the shaft, and an arm catch appended to the head and positioned to lie between the rail lock and said one of the rail pivot posts and engage the rail lock in latching relation upon movement of the selected floor support rail to the erected configuration.

12. The playyard support frame of claim 11, wherein the base is formed to include a rail-receiving channel, the inner end of the selected floor support rail is positioned to lie in the rail-receiving channel, the rail lock includes a lock body mounted to slide back and forth in the rail-receiving channel and a lock arm coupled to the lock body and arranged to engage the arm catch in the rail-receiving channel upon movement of the selected floor support rail to the erected configuration.

13. The playyard support frame of claim 12, wherein said one of the rail pivot posts is positioned to extend transversely through the rail-receiving chamber.

14. The playyard support frame of claim 13, wherein the base includes a pair of interior walls lying in spaced-apart relation to one another to define the rail-receiving channel therebetween and each interior wall is formed to include a post-receiving opening receiving one end of said one of the rail pivot posts therein.

15. A playyard floor support frame comprising four corner feet, a rail mount, four floor support rails, each floor support rail including an outer end pivotably coupled to one of the corner feet and an inner end pivotably coupled to the rail mount to enable collapsing movement of the floor support rails between an erected configuration wherein the floor support rails are arranged to lie in an X-shaped pattern and adapted to support a floor mat thereon and above the rail mount and a collapsed configuration wherein the floor support rails are arranged to lie in mutually parallel relation to facilitate storage of the floor support frame, and a rail lock apparatus coupled to and positioned to lie in the rail mount and configured to latch onto a stationary end piece mounted on the inner end of at least one of the floor support rails and to block pivoting movement of the at least one of the floor support rails relative to the rail mount to lock the at least one of the floor support rails to the rail mount upon movement of the floor support rails relative to the rail mount to the erected configuration.

16. The frame of claim 15, wherein the rail mount includes a base and the rail lock apparatus includes two rail locks mounted for movement in the base between engaged positions engaging and locking the at least one of the floor support rails against movement relative to the base to establish the erected configuration and released positions unlocking the selected support rails to allow pivotable movement of the at least one floor support rails about the pivot axes to the collapsed configuration.

17. The frame of claim 16, wherein the rail lock apparatus further includes means for yieldably biasing each rail lock to the engaged position.

18. The frame of claim 16, wherein the rail lock apparatus further includes a lever pivotably coupled to the base for movement about a horizontal pivot axis between locked and unlocked positions and the lever is coupled to the two rail locks and configured to move the two rail locks toward one another to assume the released positions in response to pivoted movement of the lever relative to the base about the horizontal pivot axis of the lever.

19. The frame of claim 18, wherein the rail lock apparatus further includes means for yieldably biasing each rail lock to the engaged position.

20. The frame of claim 15, wherein the rail mount includes a base and the rail lock apparatus includes a rail lock mounted for movement in the base between an engaged position engaging and locking the inner end of one of the floor support rails against movement relative to the base to establish the erected configuration and a released position unlocking the inner end of said one of the floor support rails to allow pivotable movement of the floor support rails to the collapsed configuration.

21. The frame of claim 20, wherein the rail lock apparatus further includes means for yieldably biasing the rail lock to the engaged position.

22. A playyard floor support frame comprising a rail mount including a base and rail pivot posts coupled to the base, at least two floor support rails, each floor support rail including an inner end pivotably coupled to one of the rail pivot posts of the rail mount to enable each floor support rail to be moved relative to the rail mount about a rail pivot axis between an erected configuration adapted to support a floor mat on the floor support rails and above the rail mount and a collapsed configuration adapted to facilitate storage of the floor support frame, and a rail lock apparatus coupled to the rail mount and configured to latch onto an arm catch of a stationary end piece mounted on the inner end of selected floor support rails and to block pivoting movement of the selected floor support rails relative to the rail mount about the rail pivot axes to lock the selected floor support rails to the rail mount upon movement of the floor support rails relative to the rail mount to the erected configuration, each arm catch being positioned to lie between the rail lock apparatus and one of the rail pivot posts upon movement of the selected floor support rails to the erected configuration.

23. The playyard support frame of claim 22, wherein each stationary end piece further includes a shaft coupled to the inner end of the selected floor support rail and a head appended to the shaft, and each arm catch is appended to one of the heads and positioned to lie between the rail lock and one of the rail pivot posts and engage the rail lock apparatus in latching relation upon movement of the selected floor support rail to the erected configuration.

24. The playyard support frame of claim 23, wherein the base is formed to include rail-receiving channels, the inner end of each selected floor support rail is positioned to lie in one of the rail-receiving channels, and the rail lock apparatus includes a lock body mounted to slide back and forth in each rail-receiving channel and a lock arm coupled to each lock body and arranged to engage the arm catch at a location in the companion rail-receiving channel.

25. The playyard support frame of claim 24, wherein each one of the rail pivot posts is positioned to extend transversely through one of the rail-receiving channels.

26. The playyard support frame of claim 25, wherein the base includes a pair of interior walls lying in spaced-apart relation to one another to define the rail-receiving channel therebetween and each interior wall is formed to include a post-receiving opening receiving one end of said one of the rail pivot posts therein.

* * * * *